US007398666B2

(12) United States Patent
Denker

(10) Patent No.: US 7,398,666 B2
(45) Date of Patent: Jul. 15, 2008

(54) METHOD OF AND INSTALLATION FOR ROLLING IN-PROCESS STOCK

(75) Inventor: Wolfgang Denker, Dusseldorf (DE)

(73) Assignee: SMS_Demag AG, Dusseldorf (DE)

( * ) Notice: Subject to any disclaimer, the term of this patent is extended or adjusted under 35 U.S.C. 154(b) by 146 days.

(21) Appl. No.: 10/576,848

(22) PCT Filed: Nov. 8, 2004

(86) PCT No.: PCT/EP2004/012601

§ 371 (c)(1),
(2), (4) Date: Apr. 20, 2006

(87) PCT Pub. No.: WO2005/056206

PCT Pub. Date: Jun. 23, 2005

(65) Prior Publication Data

US 2007/0034672 A1 Feb. 15, 2007

(30) Foreign Application Priority Data

Dec. 10, 2003 (DE) ..... 103 57 622

(51) Int. Cl.
*B21B 41/06* (2006.01)

(52) U.S. Cl. ..... 72/229; 72/146; 72/206; 72/365.2

(58) Field of Classification Search ..... 29/33 Q, 29/335; 72/146, 203, 205, 206, 221, 229, 72/250, 227, 365.2, 366.2

See application file for complete search history.

(56) References Cited

U.S. PATENT DOCUMENTS

| | | | | |
|---|---|---|---|---|
| 2,105,736 | A | 1/1938 | Hudson | |
| 4,123,011 | A * | 10/1978 | Kajiwara et al. | 242/533.7 |
| 5,495,736 | A * | 3/1996 | Nishi et al. | 72/39 |
| 5,706,690 | A * | 1/1998 | Connolly | 72/229 |
| 6,134,934 | A * | 10/2000 | Moser et al. | 72/202 |
| 6,216,516 | B1 * | 4/2001 | Klamma et al. | 72/229 |
| 6,237,205 | B1 * | 5/2001 | Yoshimura et al. | 29/33 Q |
| 6,604,398 | B1 | 8/2003 | Hansen | |

* cited by examiner

*Primary Examiner*—Edward Tolan
(74) *Attorney, Agent, or Firm*—Abelman Frayne & Schwab

(57) ABSTRACT

The invention relates to a method of rolling a strip-shaped in-process stock, in particular a metal strip, with which, a metal strip (3) is unwound from a coil (2, 7) held on an unwinding reel (1, 6), is fed into a reversing rolling mill (8), is rolled, and is wound-up onto a winding-up reel (9) to form a coil (10), wherein the metal strip (3) is reversibly conveyed from the unwinding reel (1, 6) to the winding-up reel (9) until a set thickness is reached and, with each passing of the reversing rolling mill (8), is subjected to a reduction of thickness, and wherein an end of the metal strip (3) of a first coil is welded to a beginning of the metal strip (3) of the second coil, and the metal strip (3) of the first coil is temporarily stored in a strip store during a welding process, and finally, the in-process stock consisting of two lengths is reversibly rolled to a final dimension, and an additional length is welded to the end of the in-process stock before the last pass.

The invention also relates to an installation for effecting the method and in which the unwinding reel (1, 6) is used as a strip store for the reverse pass.

5 Claims, 1 Drawing Sheet

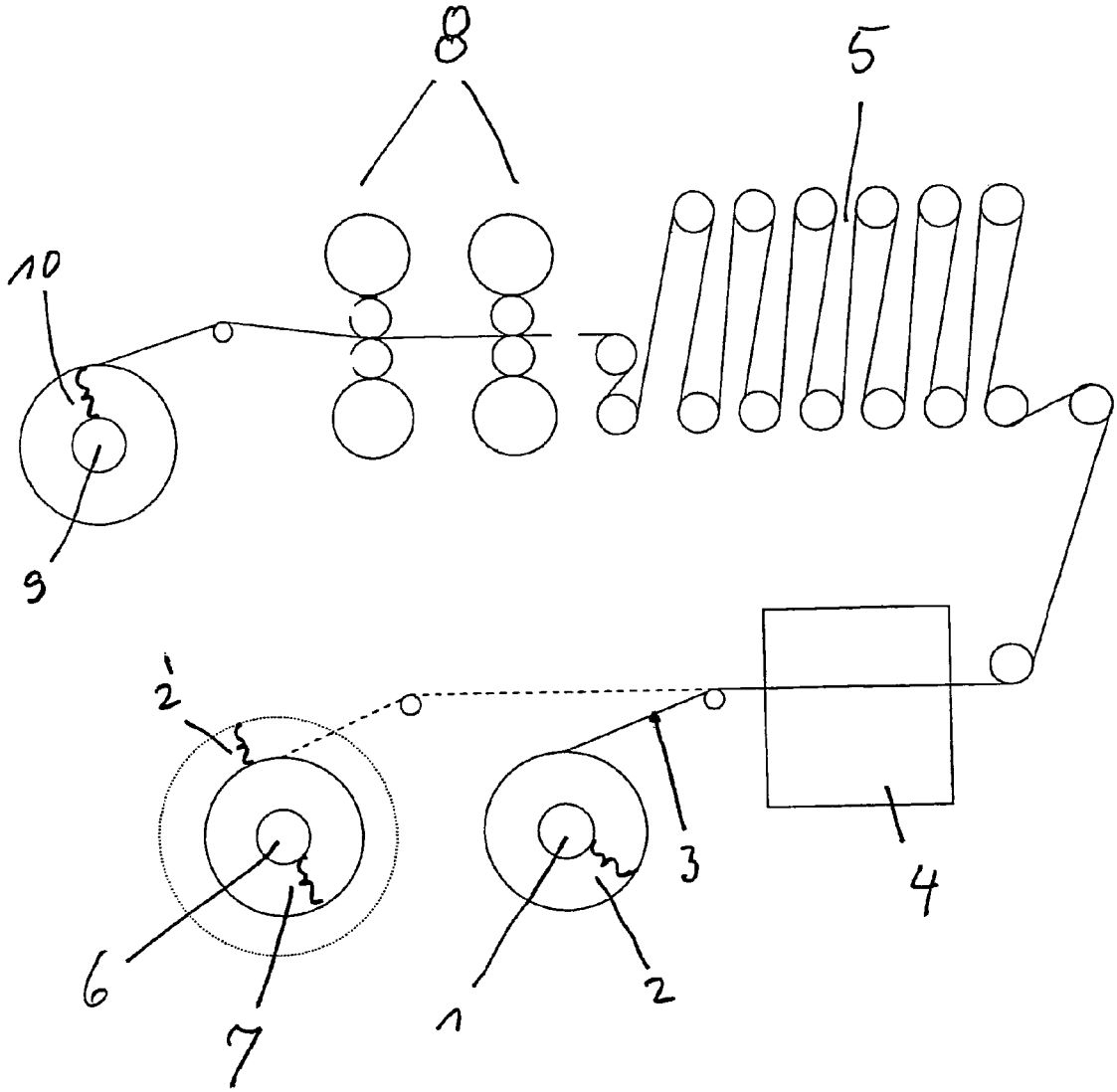
8
5
10
9
2'
3
4
6
7
1
2

METHOD OF AND INSTALLATION FOR ROLLING IN-PROCESS STOCK

The invention relates to a method of and an installation for rolling a strip-shaped in-process stock in particular a metal strip, and including at least one reversing rolling mill, at least one reel arranged in front of and behind thereof for winding up and unwinding of the metal strip, a welding apparatus, and a strip store.

For rolling an in-process stock, in particular a metal strip, different methods and installations are used. Thus, single stands, reversing stands, tandem rolling mills, and continuous rolling trains are available.

In order to effect a reduction of an in-process stock to a final thickness the in-process stock should pass single stands several times. When several rolling mill stands are arranged one after another to form a tandem rolling mill, the in-process stock should pass the tandem rolling mill only once. The reduction of thickness from a base size to a final size determines the number of installed rolling mill stands. Continuous trains represent a further development of the tandem rolling mills. With this, the strip end of the in-process stock of one coil is connected with a strip beginning of a next coil, e.g., by welding. The advantage of such installation or such a method consists in that the need of insertion of the in-process stock from each coil is eliminated, and the in-process stock is continuously available for the rolling mill train.

However, such an installation can be economically operated only at a large throughput.

With a small amount of all in-process stock, installations with a small number of rolling mill stands are contemplated. Here, a method and an installation are provided, with which the in-process stock passes one or two rolling mill stands several times, without the in-process stock leaving the roll gap. With this, the in-process stock, which is to be wound up to form a coil, is fed from an unwinding reel through one or several rolling mill stands and is wound up on a further reel. In order to effect rolling in several passes, the stock is reciprocated between adjustable rolls.

German Publication DE 43 10 063 A1 discloses an installation for cold rolling of a strip-shaped stock in a single reversing rolling mill stand which is arranged between two reversible reels and includes a reel from which an in-process strip is unwound.

U.S. Pat. No. 2,105,736 discloses a reversing installation with which a stock with a continuous length is rolled off. Here, the installation includes a horizontal strip store arranged, respectively, in front of and behind the rolling mill stand. The in-process stock is fed from a reel to a front strip store. The beginning of the next coil is welded to the strip end of the first coil and is deformed in a rolling mill stand by a reversing process.

However, such installations can be economically operated only at a large throughput.

Accordingly, an object of the invention is a method and an installation that permit an economical treatment of the in-process stock with at least one reversing rolling mill.

This object is achieved according to the invention with a method with which the metal strip is wound up on the unwinding reel during the reverse passes, and a strip beginning of a further metal strip is welded to the strip end of the metal strip before the last pass.

In the inventive installation, the unwinding reel is used as a strip store for the reverse passes.

The embodiments of the invention are recited in the dependent claims.

By welding together two coil lengths, shorter following periods are achieved. In addition, the quantity of waste lengths is reduced because the strip ends are rolled off, and the strip beginning of each further coil is rolled off at least once. Also with the method and installation according to the present invention, the strip beginning and the strip end are always rolled off under optimal tension conditions.

According to an advantageous embodiment of the installation according to the present invention, one of the unwinding reels is simultaneously used as a winding-up reel for a pickling line located upstream. Thereby a costly transportation of separate coils is prevented, and a danger of coils being damaged during the transportation is eliminated.

The present invention further contemplates integration of the pickling line into the installation, e.g., between the welding apparatus and the reversing rolling mill. With this, an adapted, larger strip store is provided.

An embodiment of the invention will be described in detail below based on a very schematic drawing. It is shown in:

FIG. 1 a two-stand reversing rolling mill according to the invention with a welding apparatus, strip store, and winding-up and unwinding reels.

A single FIGURE shows a reversing rolling mill. A metal strip 3 is unwound from a coil 2 held on an unwinding reel 1 and is fed through a welding apparatus 4, a strip store 5, and a rolling mill stand 8, to a winding-up reel 9 for a first rolling of the coil. Another coil 7 is pre-positioned on a further unwinding reel 6.

At a last one-third of the coil 2, the strip store 5 is actuated in order to bridge the time span to weld the end of the strip form coil 2 with the beginning of the strip from coil 7 for further rolling. Thereby, the metal strip 3 can be rolled off up to the welding seam and several meters beyond that. Upon reversing, for rolling the metal strip 3 to a set thickness by subsequent rolling, the joint metal strip 3 is alternatively wound up on the reel 6 and the reel 9. On the unwinding reel 1, a following coil is already positioned in order to be welded to an end of the metal strip 3 from coil 7.

After the set thickness has been reached, the metal strip 3 is wound up on the winding-up reel 9 to from a coil 10 having a predetermined length. With this, the metal strip 3 is cut off. After the finished coil 3 is taken off from the winding-up reel 9, the remaining metal strip 3 is connected with the winding-up reel 9. Simultaneously, in the welding apparatus 4, a further metal strip 3 from the coil 2 or the coil 7 on the unwinding reel 1 or 6 is welded with the non-deformed metal strip 3 that remains in the strip store 5. Finally, a further deformation of the following length of the metal strip 3 follows without interruption.

The same installation permits to form and roll, to feed and to unwind so-called jumbo-coils (with two or more normal coils forming one coil) in order to cut in half the time-consuming direction reversal of a reversing rolling mil installation. This is based on a premise that the metal strips of the coil have the same dimensions.

The invention claimed is:

1. An installation for rolling a metal strip, comprising at least one reversing, rolling mill stand (8); first (1) and second (6) unwinding reels for receiving, respectively, first (2) and second (7) coils of to-be-rolled first (3) and second (10) strips, respectively; an apparatus (4) for welding a beginning of one of the first and second strips (3, 10) with an end of another of the first and second strip (3, 10) and arranged downstream of the first and second reels (1, 6) and upstream of the rolling mill stand (8); a strip store (5) arranged between the welding apparatus (4) and the rolling mill stand (8); and a winding-up reel (9) arranged downstream of the rolling mill stand (8) for receiving a rolled strip.

2. An installation according to claim 1, wherein the unwinding reels (1, 6) are simultaneously used as winding up reels for a pickling line located upstream.

3. An installation according to claim 1, wherein the winding-up reel (9)) is formed as one of a single reel and as a carousel reel.

4. An installation according to claim 1, wherein a pickling line is integrated between the welding apparatus (4) and the strip store (5).

5. A method of rolling a metal strip, comprising the steps of: providing a strip rolling installation including at least one reversing rolling mill stand (8), first (1) and second (6) rewinding reels for receiving respectively, first (2) and second (7) coils of to-be-rolled first (3) and second (10) strips, respectively, an apparatus (4) for welding a beginning of one of the first and second strips (3, 10) with an end of another of the first and second strip (3, 10) and arranged downstream of the first and second reels (1, 6) and upstream of the rolling mill stand (8), a strip store (5) arranged between the welding apparatus (4) and the rolling mill stand (8), and a winding-up reel (9) arranged downstream of the rolling mill stand (8) for receiving a rolled strip;

unwinding one of the first and second strips (3, 10) from a respective one of the first and second coils (2, 7);

feeding the one of the first and second strips (3, 10) into the rolling mill stand (8);

rolling the one of the first and second strips (3, 10) in the rolling mill sand (8);

winding the rolled one of the first and second strips (3, 10) onto the winding-up reel (9);

reversibly conveying the one of the first and second strips (3, 10) between a respective one of the first and second unwinding reels (1, 6) and the winding-up reel (9) until a set strip thickness is reached; and welding a beginning of another of the first and second strips (3, 10) to an end of the one of the first and second strips (3, 10) before a last pass of the one of the first and second strips (3, 10) through the rolling mill stand (3), while actuating the strip store (5) to bridge a time span associated with welding of the beginning of the another of the first and second strips (3, 10) with the end of the one of the first and second strips (3, 10).

* * * * *